United States Patent [19]

Rommel

[11] Patent Number: 4,608,888

[45] Date of Patent: Sep. 2, 1986

[54] PLIER TYPE TOOL WITH MOTION COMPELLING MECHANISM

[76] Inventor: Reiner Rommel, Moldaustrasse 6, 3570 Stadt Allendorf, Fed. Rep. of Germany

[21] Appl. No.: 716,483

[22] Filed: Mar. 27, 1985

[30] Foreign Application Priority Data

Mar. 28, 1984 [DE] Fed. Rep. of Germany ..... 3411459

[51] Int. Cl.[4] ..... B25B 7/00

[52] U.S. Cl. ..... 81/313; 72/409

[58] Field of Search ..... 81/313; 72/409, 410; 74/17.5

[56] References Cited

U.S. PATENT DOCUMENTS 2,618,993 11/1952 Carlson ..... 81/313 X 4,158,302 6/1979 O'Loughlin ..... 81/313 X

*Primary Examiner*—Frederick R. Schmidt

*Assistant Examiner*—Debra S. Meislin

*Attorney, Agent, or Firm*—Thomas & Kennedy

[57] ABSTRACT

The invention relates to a tool for crimping, cutting, pressing or the like, having a tool head and gripping levers arranged on the latter for actuating the tools and also, in order to fix the final pressure required for pressing, having a positive lock which is engaged between the gripping levers and designed as a ratchet, having a toothed segment which is provided on one gripping lever and a pawl on the other gripping lever, which pawl engages in the toothed segment, with the mounting of the pawl (6) in the gripping lever (2) being adjustable in order to change the final pressure required for pressing.

2 Claims, 3 Drawing Figures

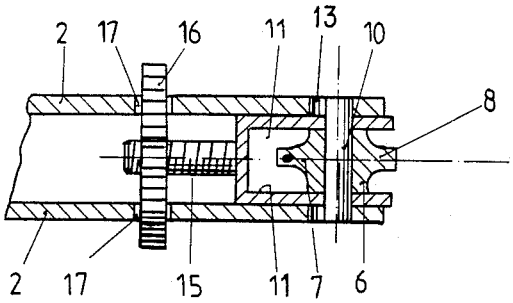
Fig. 3
FIG. 1
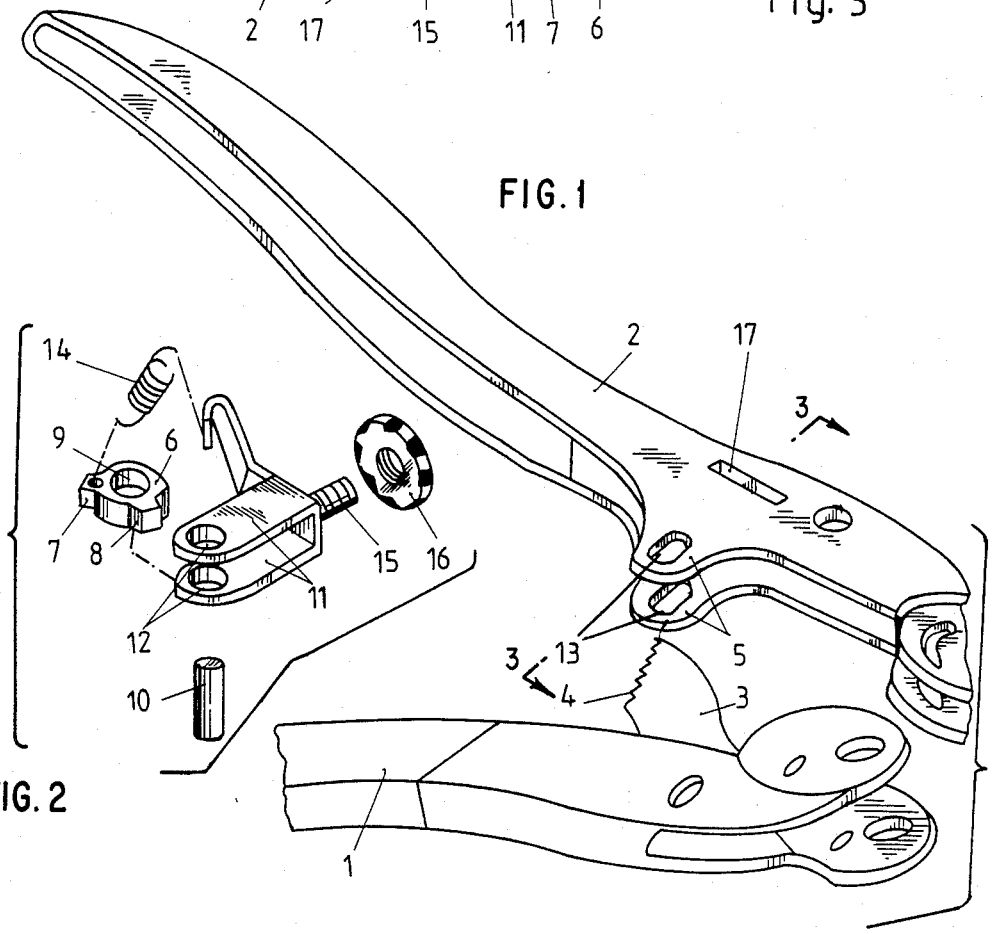
FIG. 2

PLIER TYPE TOOL WITH MOTION COMPELLING MECHANISM

FIELD OF THE INVENTION

The invention relates to a tool for crimping, cutting, pressing or the like, having a tool head and gripping levers arranged on the latter for actuating the tools and also, in order to fix the final pressure required for pressing, having a positive lock which is engaged between the gripping levers and designed as a ratchet.

BACKGROUND OF THE INVENTION

Tools are already being used and are provided with a toothed segment which is provided on one gripping lever and a pawl on the other gripping lever, which pawl engages in this toothed segment. The drawback of such tools is that they have to be reopened when exceeding only one single final pressure, the consequence of which is that all work pieces to be processed must have the same final pressure. This manifests itself disadvantageously in practice if the tool is to find application for various work and various work pieces.

SUMMARY OF THE INVENTION

The object of the invention is to remove this drawback and to create a generally applicable tool which is to be adapted to the most varied work pieces and to the respective final pressure required.

This is achieved according to the invention by the mounting of the pawl in the gripping level being adjustable in order to change and set the final pressure required for pressing.

The pawl preferably rests in a yoke which is mounted in the direction of the toothed segment in the gripping lever by a threaded pin which sits on the yoke and by an adjusting nut. Moreover, the pawl is acted upon by a spring which retracts it into the stop position after every operation.

The idea behind the invention permits the most varied embodiment possibilities. One of them is shown in the attached drawing.

BRIEF DESCRIPTION OF THE DRAWINGS

FIG. 1 shows a part of a tool for crimping, cutting, pressing or the like,

FIG. 2 shows to an enlarged scale a view of the components required for the positive lock, and FIG. 3 shows a section along lines I—I through FIG. 1.

DETAILED DESCRIPTION

Of the the tool in question, only the two operating grips 1 and 2 are shown which are pivoted on one another and can be opened or closed in articulated manner in order to actuate the tool. The two gripping levers are normally pressed from sheet metal. As shown in FIG. 1, they have a U-shaped cross-section which is open towards the other gripping lever.

At a certain distance from the link pin, the gripping lever 1 has a toothed segment 3 which points inwards and carries the toothing 4 on its outer side. On the other gripping lever 2, however, a mounting 5 is provided which projects inwards and in which the pawl 6 rests which interacts with the toothing 4 on the toothed segment 3.

The pawl 6, on one side (FIG. 2), is provided with a projecting nose 7 and a lever 8. By means of a hole 9, it rests freely rotatable on a pivot pin 10 which is inserted into the openings 12, of a yoke 11, but which also extends into the slotted openings 13 of the mounting 5 and acts here as a guide. The pawl 6 is repeatedly retracted into its stop position by a tension spring 14.

A threaded pin 15 also sits on the yoke 11, onto which threaded pin 15 is screwed an adjusting nut 16 which at the same time, however, is guided in a slot 17 of the gripping lever 2, so that, by turning the nut 16 to a greater or lesser extent, the yoke 11, together with the pawl 6 mounted inside it, can be retracted to a greater or lesser extent. By this means, the time of engagement of the pawl 6 in the toothed segment 3 and 4, and consequently the time of reaching the final pressure required for pressing, is changed.

Of course, the positive lock according to the invention can be used in all types of tools which are actuated by pivotable gripping levers, that is, for example, pliers of all types and tools for crimping, cutting, pressing or the like, and having a linear work path, where it is important not to open or release the tool provided that the final pressure required for forming the work piece has not been reached.

I claim:

1. A plier type tool including a pair of gripping levers pivotably connected together and a motion compelling mechanism connected to said gripping levers for requiring the gripping levers to pivot toward each other to a predetermined final closed position before the levers can be moved apart, the improvement therein of:

said motion compelling mechanism comprising a toothed segment rigidly mounted to one of said gripping levers including a series of ratchet teeth with the toothed segment oriented such that the series of teeth extend in a direction from one gripping lever toward the other gripping lever, a pawl assembly adjustably mounted to the other of said gripping levers, said pawl assembly including a pawl support yoke, a pawl pivotably supported in said pawl support yoke at a position for engaging the ratchet teeth of said one gripping lever and preventing movement of the gripping levers apart from each other until the pawl has traversed all of said ratchet teeth, and spring means extending between and in engagement with said pawl and said pawl support yoke for biasing said pawl to a predetermined position, and pawl position adjustment means mounted to said other gripping lever for moving said pawl support yoke toward and away from said one gripping lever in directions corresponding to the orientation of toothed segment and said said ratchet teeth, whereby the predetermined final closed position of the gripping levers can be adjusted by said pawl position adjustment means.

2. The plier type tool of claim 1 and wherein said pawl support yoke comprises a pair of parallel spaced plates defining aligned openings therethrough, and wherein said pawl defines an opening therein aligned with the aligned openings of said pawl support yoke, and wherein said other gripping lever defines a slot therein aligned with the openings of said support yoke and the opening of the pawl and having its long dimension oriented in a direction corresponding to the orientation of said ratchet teeth and a pivot pin extending through the aligned openings of said support yoke and said pawl and the slot of said other gripping lever, said adjustment means including a helically threaded stem mounted to said support yoke, and a threaded adjusting nut threaded to said stem, said adjusting nut rotatably mounted to said other gripping lever, whereby rotation of said adjusting nut moves said pawl support yoke and pawl and said pivot pin with respect to said other gripping lever in directions corresponding to the long dimension of the slot of said other gripping lever.

* * * * *